US006483261B2

(12) United States Patent
Fukuda et al.

(10) Patent No.: US 6,483,261 B2
(45) Date of Patent: Nov. 19, 2002

(54) CATHODE RAY TUBE APPARATUS EQUIPPED WITH DEFLECTION YOKE

(75) Inventors: Yutaka Fukuda, Kumagaya (JP); Ryu Kobayashi, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/862,309

(22) Filed: May 23, 2001

(65) Prior Publication Data

US 2002/0047655 A1 Apr. 25, 2002

(30) Foreign Application Priority Data

May 24, 2000 (JP) ..... 2000-153383

(51) Int. Cl.[7] ..... G09G 1/28; H01J 29/51

(52) U.S. Cl. ..... 315/362.28; 313/1

(58) Field of Search ..... 315/364, 368.11, 315/368.25, 368.26; 313/364, 402, 408, 409, 414, 415, 440, 1

(56) References Cited

U.S. PATENT DOCUMENTS 4,631,439 A * 12/1986 D'Amato et al. ..... 313/402
5,021,719 A * 6/1991 Arai et al. ..... 315/364
5,059,858 A * 10/1991 Shimoma et al. ..... 313/440
5,430,351 A * 7/1995 Yokota ..... 313/413
6,215,257 B1 * 4/2001 Choe ..... 315/368.28
6,218,773 B1 * 4/2001 Misono et al. ..... 313/440
6,291,948 B1 * 9/2001 Yasui et al. ..... 315/3
6,337,546 B1 * 1/2002 Inoue ..... 313/477 R

FOREIGN PATENT DOCUMENTS

JP 61-104544 5/1986

* cited by examiner

*Primary Examiner*—Don Wong
*Assistant Examiner*—Minh D A
(74) *Attorney, Agent, or Firm*—Pillsbury Winthrop LLP

(57) ABSTRACT

A deflection yoke includes a pair of horizontal deflection coils facing each other with the horizontal axis interposed therebetween, for deflecting the electron beams in a direction of a first axis, and a pair of vertical deflection coils facing each other with the vertical axis interposed therebetween, for deflecting the electron beams in a direction of the second axis. The winding of each horizontal deflection coil is wound such that the horizontal axis side bears a relatively high potential and the vertical axis side bears a relatively low potential, and includes a first terminal provided on the high potential side, a second terminal provided on the low potential side, and a third terminal provided at the intermediate portion of the winding and positioned on the side of the low potential relative to a portion where the inductance of the horizontal deflection coil is equally divided into two halves.

10 Claims, 4 Drawing Sheets

CATHODE RAY TUBE APPARATUS EQUIPPED WITH DEFLECTION YOKE

CROSS-REFERENCE TO RELATED APPLICATIONS

This application is based upon and claims the benefit of priority from the prior Japanese Patent Application No. 2000-153383, filed May 24, 2000, the entire contents of which are incorporated herein by reference.

BACKGROUND OF THE INVENTION

The present invention relates to a cathode ray tube apparatus, particularly, to a cathode ray tube apparatus equipped with a deflection yoke having horizontal and vertical deflection coils.

In general, a cathode ray tube apparatus comprises a vacuum envelope including a substantially rectangular panel, a funnel contiguous to the panel, and a cylindrical neck contiguous to the small diameter portion of the funnel. A phosphor screen including a plurality of phosphor layers emitting red, green and blue lights and a light shielding layer is formed on the inner surface of the panel. A deflection yoke is mounted to the outer circumferential surface ranging from the neck to the funnel, and an electron gun assembly emitting three electron beams corresponding to the colors of the emitted lights on the phosphor screen is arranged within the neck.

A shadow mask performing the color selecting function is arranged inside the panel between the electron gun assembly and the phosphor screen so as to shape the electron beam emitted from the electron gun assembly and to project the shaped electron beam as a beam spot on the phosphor layer with a predetermined color.

The deflection yoke includes horizontal deflection coils for deflecting in a direction of the horizontal axis the three electron beams emitted from the electron gun assembly in the direction of the tube axis and vertical deflection coils for deflecting the three electron beams in a direction of the vertical axis perpendicular to the tube axis and the horizontal axis. In a high precision color cathode ray tube apparatus achieved in recent years, the horizontal deflection coils comprise two saddle type coils opposing to each other with interposing the horizontal axis therebetween and connected in parallel to each other. Likewise, the vertical deflection coils comprise two saddle type coils arranged in series with the vertical axis interposed therebetween.

In the color cathode ray tube apparatus of the construction described above, the horizontal deflection coils are driven by a high voltage pulse, with the result that, under certain conditions, vibration of an electric energy takes place immediately after the fall of the pulse voltage. It should be noted that the vibration of the electric energy causes the horizontal deflection current to be vibrated. As a result, a ringing, i.e., occurrence of bright-dark stripes, is generated immediately after initiation of the image scanning so as to deteriorate the image quality.

Measures for suppressing the ringing problem in the case where the ringing is caused by the deflection yoke are proposed in, for example, Japanese Patent Disclosure (Kokai) No. 61-104544 and Japanese Utility Model Disclosure No. 3-39969. Specifically, disclosed in each of these prior arts is a cathode ray tube in which one portion of the horizontal deflection coil or the vertical deflection coil is connected to another circuit portion via a resistor and a capacitor. To be more specific, Japanese Patent Disclosure No. 61-104544 teaches that a terminal is arranged in the intermediate portion of the winding of each of a pair of horizontal deflection coils that are connected in parallel. In this case, in one of the horizontal deflection coils, the terminal in the intermediate portion is connected to a high potential side with a capacitor interposed therebetween. On the other hand, in the other horizontal deflection coil, the terminal in the intermediate portion is connected to a low potential side with another capacitor interposed therebetween. It is taught that the particular construction permits changing the circuit constant so as to suppress the ringing problem.

However, where a capacitor or the like is connected to the horizontal deflection coil as proposed in Japanese Patent Disclosure NO. 61-104544, the capacitor, etc. is connected to a high potential portion having a potential of several hundred volts to 1.5 kV. It follows that a difficulty in terms of the manufacturing cost must be overcome for achieving the particular construction proposed in this prior art while ensuring a sufficient reliability in respect of the safety.

To be more specific, it is necessary to increase the size of the capacitor in order to ensure a breakdown voltage of the capacitor. Also, when it comes to the wiring, it is necessary to increase the size of the wiring substrate in order to ensure a sufficient insulating distance from the low potential portion, leading to an increase in the manufacturing cost.

BRIEF SUMMARY OF THE INVENTION

The present invention has been contrived in consideration of the above circumstances, and its object is to provide a cathode ray tube apparatus capable of suppressing the ringing problem with a high safety and at a low cost.

In order to achieve the above noted object, a cathode ray tube apparatus according to the present invention comprises a vacuum envelope including a panel having a phosphor screen formed on an inner surface thereof, and a funnel contiguous to the panel; an electron gun assembly arranged within a neck of the vacuum envelope, for emitting electron beams toward the phosphor screen; and a deflection yoke mounted on the outer circumferential surface of the neck and the funnel.

Where the vacuum envelope has a tube axis, a first axis perpendicular to the tube axis, and a second axis perpendicular to both the tube axis and the first axis, the deflection yoke includes a pair of horizontal deflection coils arranged to face each other with the first axis interposed therebetween and extending in the direction of the tube axis, for deflecting and scanning the electron beams in the direction of the first axis, and a pair of vertical deflection coils arranged to face each other with the second axis interposed therebetween and extending in the direction of the tube axis, for deflecting and scanning the electron beam in the direction of the second axis.

Each of the horizontal deflection coil and the vertical deflection coil has the distribution of the winding within an angular region sandwiched between the first axis and the second axis in a cross section including both the first axis and the second axis, the winding of each horizontal deflection coil is mainly distributed in an angular region close to the first axis, and the winding of each vertical deflection coil is mainly distributed in an angular region close to the second axis.

The pair of horizontal deflection coils are connected in parallel to each other.

Each of the horizontal deflection coils has a relatively high potential on the side of the first axis and a relatively low potential on the side of the second axis, and includes a first terminal positioned on the side of a relative high potential, a second terminal positioned on the side of a relatively low potential, and a third terminal positioned in the intermediate portion of the winding and formed on the side of a low potential relative to a portion where the inductance of the horizontal deflection coil is equally divided into two halves.

Further, a capacitor is connected between the third terminal of each of the horizontal deflection coils and the second terminal on the side of the low potential compared with the third potential or the ground potential point.

The present invention also provides a cathode ray tube apparatus, which is featured in that the third terminal of each of the horizontal deflection coils is formed on the side of the second axis, compared with the distribution angle of the winding distribution of the vertical deflection coil at the edge on the side of the first axis.

As described previously, the ringing phenomenon is caused by various factors. In general, the vibration energy of the ringing phenomenon is imparted by the horizontal deflection pulse. Where the ringing phenomenon is caused by the deflection yoke, it is considered reasonable to understand that the ringing phenomenon is caused by the resonance phenomenon between the inductance of the deflection coil and the distributed capacitance present around the deflection coil. The vibration frequency f of the vibration energy is represented by the formula given below and, thus, is determined by the inductance L and the capacitance C:

$$f=2\pi\sqrt{1/LC}$$

The inductance L is unavoidable because the inductance L is present as the deflection coil itself. The distributed capacitance C is also unavoidable because the distributed capacitance C is spontaneously generated if a potential difference is generated between two insulated conductors.

According to the cathode ray tube apparatus of the construction described above, the high potential side of each of the horizontal deflection coils is on the side of the first axis, and the second axis side close to the vertical deflection coil constitutes a low potential side. In order to suppress the vibration of the ringing caused by the coupling between the horizontal deflection coil and the vertical deflection coil, a third terminal is formed in the vicinity of the center of the winding of each of the horizontal deflection coils. It should be noted that a capacitor is connected between the third terminal and the second terminal on the side of the low potential such that the vibration generated by the distributed capacitance on the side of the second axis is suppressed by changing the resonance condition.

It should also be noted that the ringing generation is caused in that portion of each of the horizontal deflection coils which is positioned close to the vertical deflection coil. It is possible to lower the breakdown voltage of the capacitor by allowing the particular portion of the horizontal coil noted above to bear a low potential so as to lower the manufacturing cost. Also, since the third terminal is formed on the low potential side relative to the portion where the inductance of the horizontal deflection coil is equally divided into two halves, the voltage applied to the capacitor is rendered lower than a half of the horizontal deflection voltage. It follows that it is possible to shorten the insulating distance for the wiring of the capacitor so as to avoid the enlargement of the wiring substrate and, thus, to lower the manufacturing cost.

Further, according to the cathode ray tube apparatus of the present invention, a resistor is connected in series to the capacitor. Even in the case, the potential difference between the second and third terminals is smaller than that in the conventional case, with the result that it is possible to lower the current flowing into the resistor even if the capacitor is short-circuited, thereby improving the safety.

Further, the similar effect can be obtained even in the case where the third terminal of each of the horizontal deflection coils is formed on the side of the second axis, compared with the distribution angle θ at the edge on the side of the first axis of the winding distribution of the vertical deflection coil.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly point out hereinafter.

BRIEF DESCRIPTION OF THE SEVERAL VIEWS OF THE DRAWING

The accompanying drawings, which are incorporated in and constitute a part of the specification, illustrate presently preferred embodiments of the present invention, and together with the general description given above and the detailed description of the preferred embodiments given below, serve to explain the principles of the present invention.

DETAILED DESCRIPTION OF THE INVENTION

Color cathode ray tube apparatuses according to some embodiments of the present invention will now be described in detail with reference to the accompanying drawings.

Figure 1:
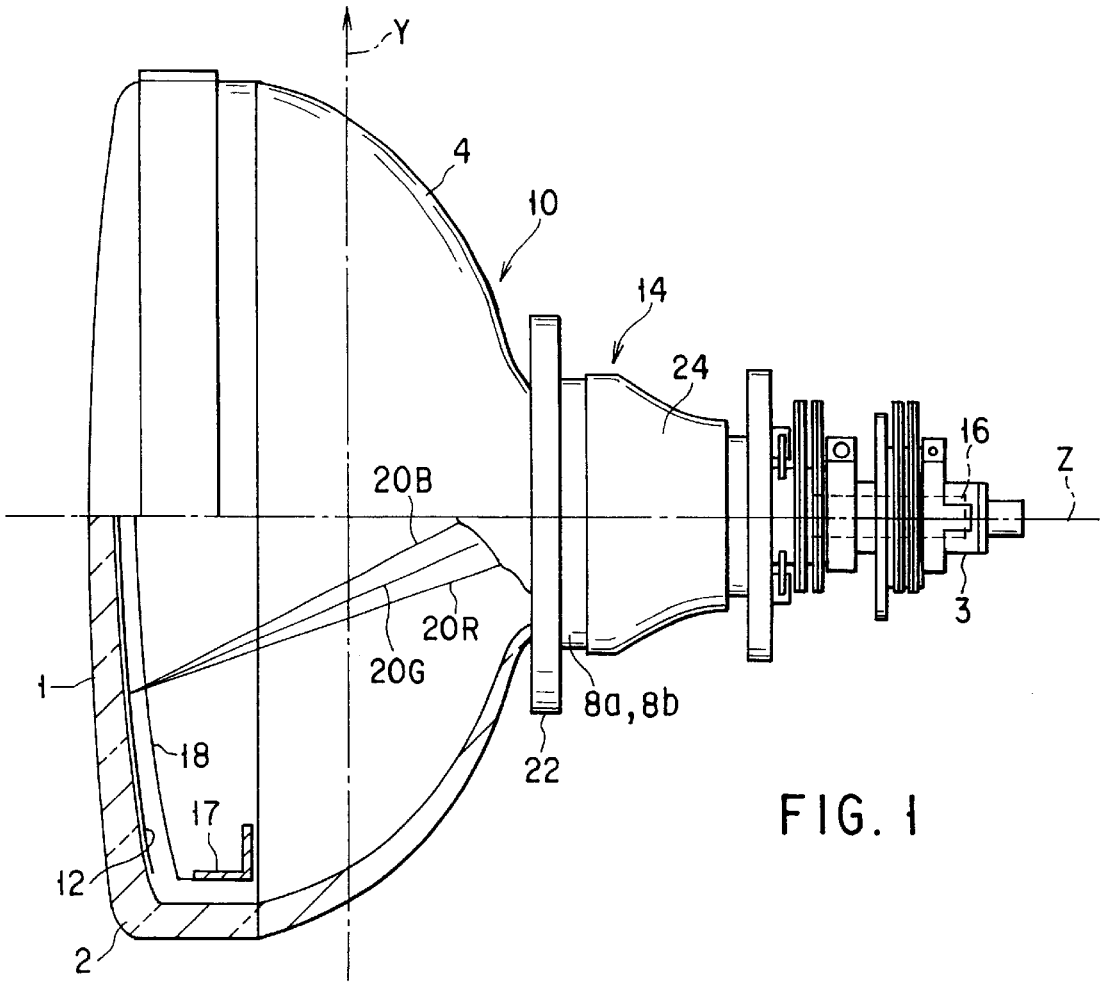
FIG. 1 is a side view, partly broken away, showing a color cathode ray tube apparatus according to a first embodiment of the present invention.
Figure 2:
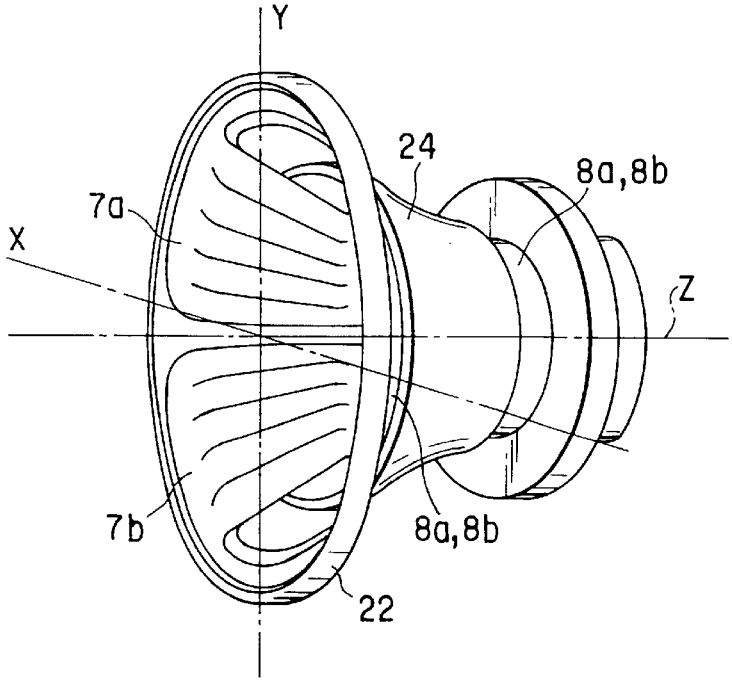
FIG. 2 is an oblique view showing the deflection yoke included in the color cathode ray tube apparatus shown in FIG. 1.

FIGS. 1 to 6 collectively show a color cathode ray tube apparatus according to a first embodiment of the present invention. As shown in FIGS. 1 and 2, the color cathode ray tube according to a first embodiment of the present invention comprises a vacuum envelope 10 including a substantially rectangular panel 1 having a skirt portion 2 in the periphery, a funnel 4 contiguous to the skirt portion of the panel 1, and a cylindrical neck 3 contiguous to the small diameter portion of the funnel 4. A phosphor screen 12 including a plurality of phosphor layers emitting red, green and blue lights and a light shielding layer is formed on the inner surface of the panel 1. A deflection yoke 14 is mounted on the outer circumferential surface ranging from the neck 3 to the funnel 4. Also, within the neck 3 is arranged electron gun assembly 16 for emitting three electron beams 20R, 20G and 20B toward the phosphor layer of the phosphor screen.

A shadow mask 18 supported by a mask frame 17 and performing the color selecting function is arranged inside the panel 1 so as to be positioned between the electron gun assembly 16 and the phosphor screen 12. The shadow mask 18 serves to shape the electron beams 20R, 20G and 20R emitted from the electron gun assembly 16 so as to project beam spots on the phosphor layers of the specified colors.

In the vacuum envelope 10, the axis coaxial with the neck 3 and extending to pass through the center of the phosphor screen 12 is called a tube axis Z, the axis perpendicular to the tube axis z and extending in the horizontal direction is called a horizontal axis (first axis) X, and the axis perpendicular to both the tube axis Z and the horizontal axis X is called a vertical axis (second axis) Y.

In the color cathode ray tube apparatus of the construction described above, the three electron beams emitted from the electron gun assembly 16 are deflected in the directions of both the horizontal axis and the vertical axis by the magnetic field generated from the deflection yoke 14 so as to be scanned via the shadow mask 18 on the phosphor screen 12 in both the horizontal and vertical directions, thereby displaying a color image on the phosphor screen.

On the other hand, the deflection yoke 14 includes a pair of horizontal deflection coils 7*a*, 7*b* generating a magnetic field for deflecting the electron beams in the direction of the horizontal axis X, and a pair of vertical deflection coils 8*a*, 8*b* generating a magnetic field for deflecting the electron beams in the direction of the vertical axis Y, as shown in FIGS. 1 to 5. Each of these horizontal deflection coils 7*a* and 7*b* is formed of a saddle type coil and is mounted on the inner circumferential surface of a separator 22 formed in the shape of a funnel. On the other hand, each of the vertical deflection coils 8*a* and 8*b*, which is a saddle type coil, is mounted on the outer circumferential surface of the separator 22. Further, a core 24 is arranged to surround these vertical deflection coils 8*a*, 8*b*.

The horizontal deflection coils 7*a*, 7*b* are arranged to face each other with the horizontal axis X interposed therebetween, and the winding portion of each of these horizontal deflection coils 7*a*, 7*b* extends in the direction of the tube axis Z. Also, the vertical deflection coils 8*a*, 8*b* are arranged to face each other with the vertical axis Y interposed therebetween, and the winding portion of each of these vertical deflection coils 8*a*, 8*b* extends in the direction of the tube axis Z.

Figure 3:
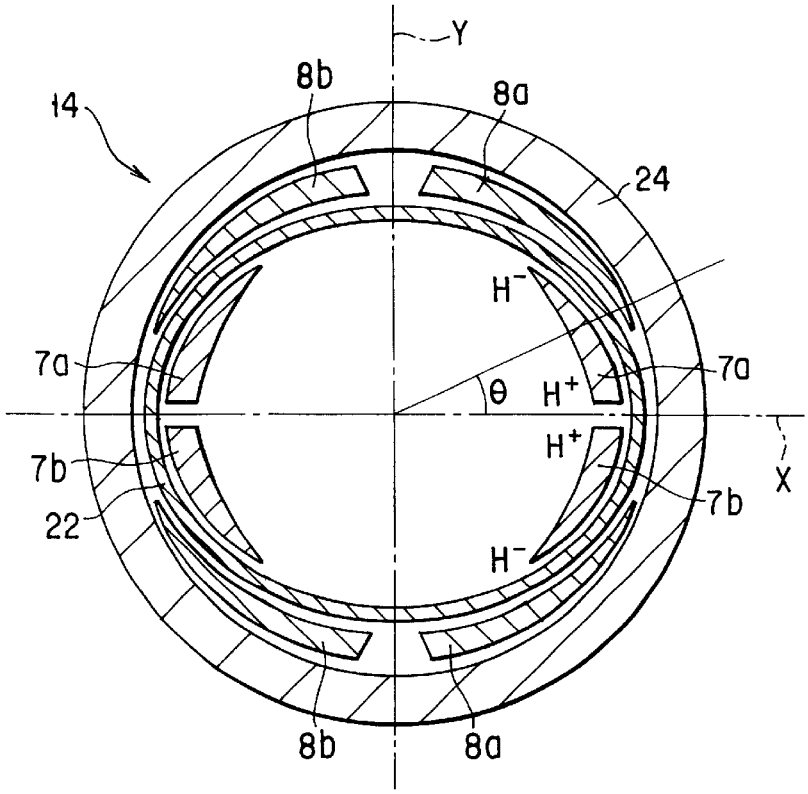
FIG. 3 is a cross sectional view along a plane including a horizontal axis and a vertical axis of the deflection yoke shown in FIG. 2.
Figure 4:
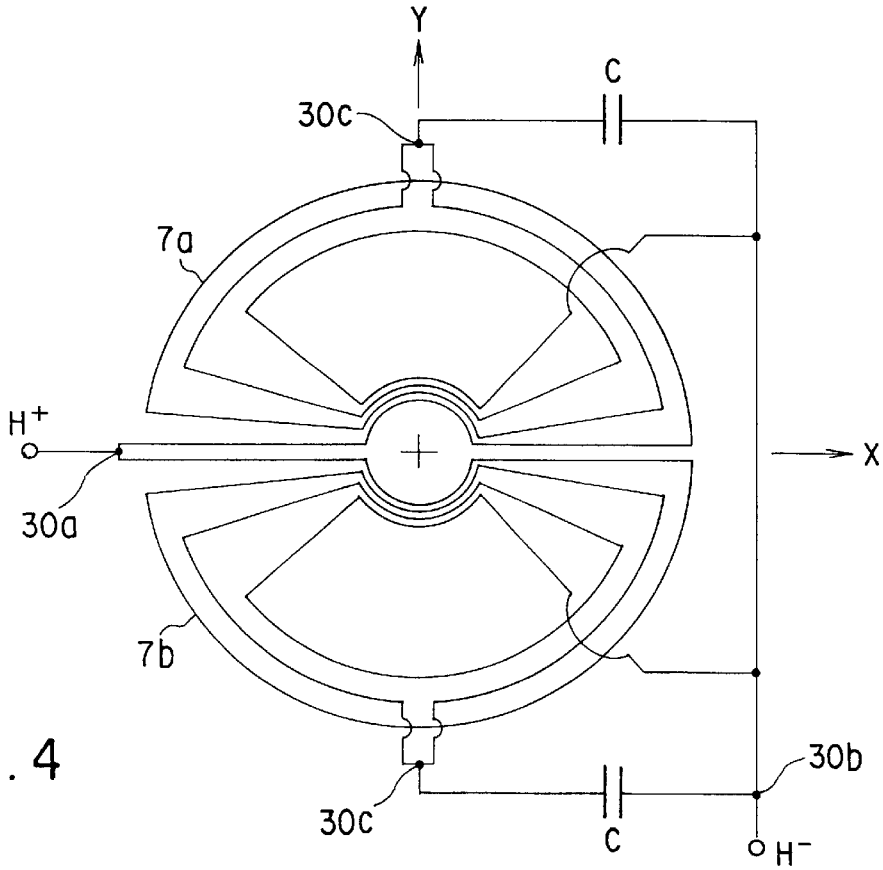
FIG. 4 is a drawing showing the connection of the horizontal deflection coil of the deflection yoke shown in FIG. 2.

As shown in FIGS. 3 and 4, in a cross section including both the horizontal axis X and the vertical axis Y, i.e., the cross section perpendicular to the tube axis Z, the windings of the horizontal deflection coils 7*a*, 7*b* are distributed within the angular regions sandwiched between the horizontal axis X and the vertical axis Y. Likewise, the windings of the vertical deflections coils 8*a*, 8*b* are distributed within the angular regions sandwiched between the horizontal axis X and the vertical axis Y. The winding of each of the horizontal deflection coils 7*a*, 7*b* is mainly distributed in an angular region close to the horizontal axis X. On the other hand, the winding of each of the vertical deflections 8*a*, 8*b* is mainly distributed in an angular region close to the vertical axis Y. It should be noted that, in the angular region sandwiched between the horizontal axis X and the vertical axis Y, the windings of the horizontal deflection coils 7*a*, 7*b* are arranged to partly overlap with the windings of the vertical deflection coils 8*a*, 8*b*. For example, in the upper right angular region sandwiched between the horizontal axis X and the vertical axis Y, the winding of the horizontal deflection coil 7*a* is arranged to overlap partly with the winding of the vertical deflection coil 8*a*, as shown in FIG. 3.

Figure 5:
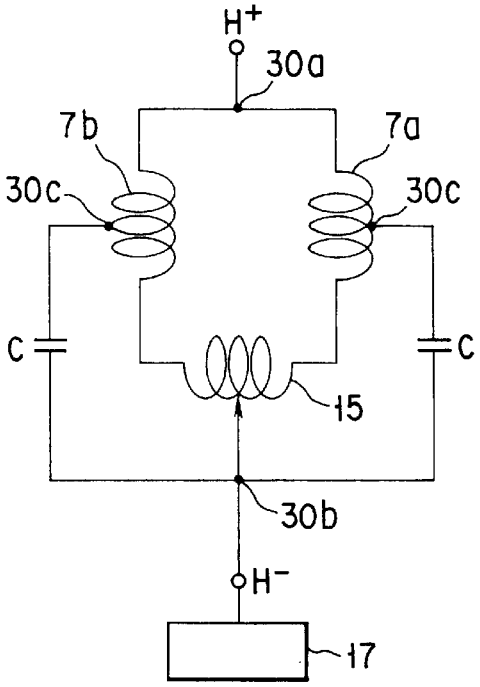
FIG. 5 is a circuit diagram of the horizontal deflection yoke.
Figure 6:
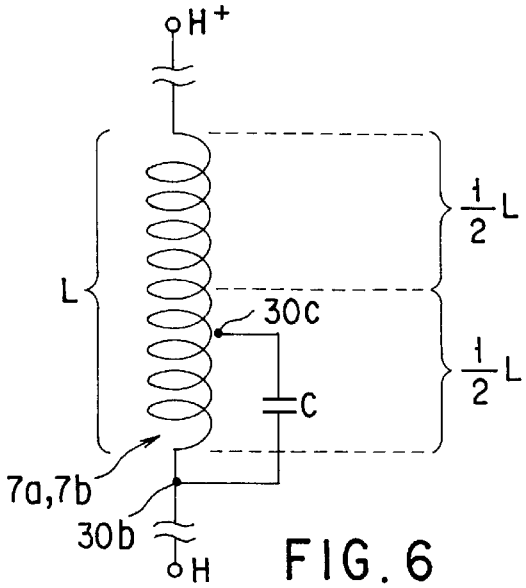
FIG. 6 is a circuit diagram showing the position of a third terminal included in the horizontal deflection yoke.

The horizontal deflection coils 7*a* and 7*b* are connected in parallel with a differential coil 15 interposed therebetween, as shown in FIG. 5. Also, these horizontal deflection coils 7*a*, 7*b* are wound in opposite directions, and each of these horizontal deflection coils has a relatively high potential ($H^+$) on the side of the horizontal axis X and a relatively low potential ($H^-$) on the side of the vertical axis Y.

As shown in FIGS. 3 to 6, each of the horizontal deflection coils 7*a* and 7*b* has a first terminal 30*a* formed on the side of the relatively high potential ($H^+$), a second terminal 30*b* formed on the side of the relatively low potential ($H^-$), and a third terminal 30*c* positioned in the intermediate portion of the winding. In the first embodiment of the present invention, the second terminal 30*b* is formed of the junction between the deflection yoke 14 and a driving circuit 17.

The third terminal 30*c* is provided on the side of the low potential ($H^-$) relative to the position at which the inductance L of the horizontal deflection coil is equally divided into two halves, i.e., at the position meeting the relationship of: (high potential side inductance)>(low potential side inductance). A capacitor C is connected between the third terminal 30*c* of each of the horizontal deflection coils and the second terminal 30*b* on the side of the lower potential, compared with the potential of the third terminal 30*c*. The capacitance of each capacitor C is selected appropriately by, for example, the inductance L of each of the horizontal deflection coils 7*a*, 7*b*, the distributed capacitance, and the ringing frequency.

According to the color cathode ray tube apparatus of the construction described above, the high potential side of each of the horizontal deflection coils 7*a* and 7*b* is positioned on the side of the horizontal axis X, and the side of the vertical axis Y close to the vertical deflection coils 8*a*, 8*b* forms the low potential side. It should be noted that the third terminal 30*c* is provided in the vicinity of the intermediate portion of the winding of each of the horizontal deflection coils 7*a* and 7*b*, and the capacitor C is arranged between the third terminal 30*c* and the second terminal 30*b* on the low potential side so as to change the resonance condition of the vibration generated by the distributed capacitance on the side of the vertical axis Y. It follows that it is possible to suppress the vibration of the ringing, which takes place by the coupling between the horizontal deflection coils 7*a*, 7*b* and the vertical deflection coils 8*a*, 8*b*.

It should be noted that the ringing problem is generated in those portions of the horizontal deflection coils 7*a*, 7*b* which are positioned close to the vertical deflection coils 8*a*, 8*b*.

What should be noted is that it is possible to lower the breakdown voltage of the capacitor C by allowing the particular portions noted above to bear a low potential ($H^-$), making it unnecessary to increase the size of the capacitor C so as to lower the manufacturing cost. It should also be noted that the voltage applied to the capacitor C can be lowered to a value smaller than a half of the horizontal deflection voltage by forming the third terminal 30*c* on the low potential side relative to the position where the inductance L of each of the horizontal deflection coils 7*a,* 7*b* is equally divided into two halves. As a result, it is possible to shorten the insulating distance for the wiring of the capacitor C so as to avoid the enlargement of the wiring substrate and, thus, to lower the manufacturing cost. It follows that it is possible to obtain a color cathode ray tube apparatus capable of lowering the ringing problem derived from the deflection yoke with a high safety and at a low cost, compared with the prior art.

Figure 7:
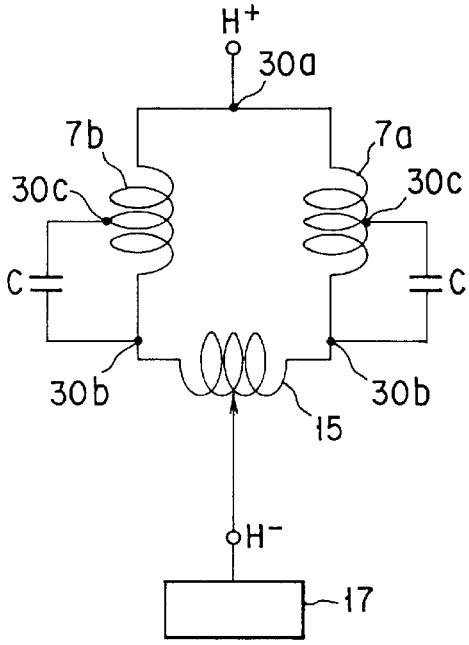
FIG. 7 is a circuit diagram of the horizontal deflection coil of the deflection yoke included in a color cathode ray tube apparatus according to a second embodiment of the present invention.
Figure 8:
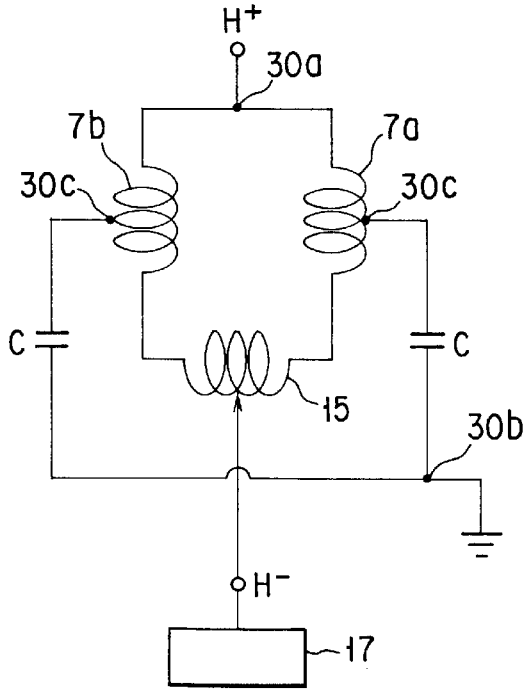
FIG. 8 is a circuit diagram of the horizontal deflection coil of the deflection yoke included in a color cathode ray tube apparatus according to a third embodiment of the present invention.

In the color cathode ray tube apparatus of the construction described above, it is possible to provide the second terminal 30*b* on the low potential side of each of the horizontal deflection coils 7*a,* 7*b* at a position close to the edge on the low potential side of each of these horizontal deflection coils as in the second embodiment of the present invention shown in FIG. 7, or in the ground potential point as in the third embodiment of the present invention shown in FIG. 8.

Figure 9:
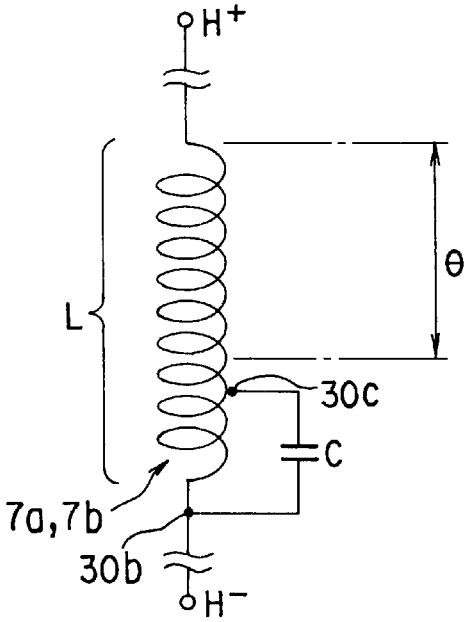
FIG. 9 is a circuit diagram showing the position of a third terminal in the horizontal deflection coil of the deflection yoke, which is included in a color cathode ray tube apparatus according to a fourth embodiment of the present invention.

According to a fourth embodiment of the present invention shown in FIG. 9, the third terminal 30*c* of each of the horizontal deflection coils 7*a,* 7*b* is provided on the low potential side relative to an angle θ, i.e., the angle θ shown in FIG. 3, which is defined between the horizontal axis X and a straight line passing through both the center of the deflection yoke 14 and the edge of the winding distribution of each of the vertical deflection coils 8*a,* 8*b*.

In each of the second to fourth embodiments described above, another structure thereof is equal to that in the first embodiment described previously. Therefore, the same constituents of the color cathode ray tube apparatuses are denoted by the same reference numerals throughout the accompanying drawings for avoiding the overlapping description. Also, each of the second to fourth embodiments produces the function and effect similar to those obtained from the first embodiment of the present invention.

Figure 10:
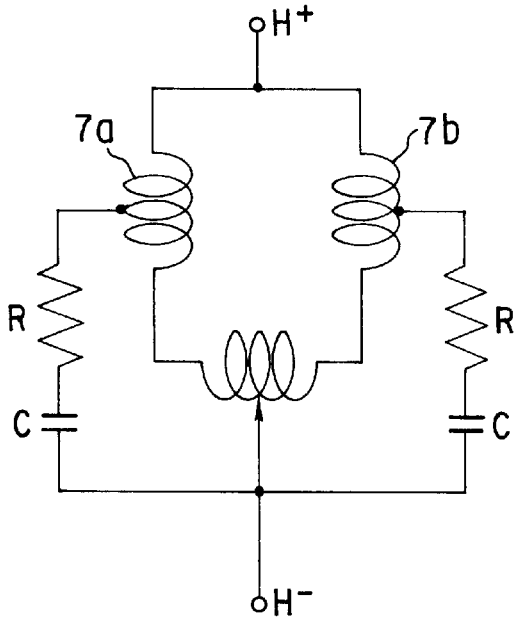
FIG. 10 is a circuit diagram of the horizontal deflection coil of the deflection yoke included in a color cathode ray tube apparatus according to a fifth embodiment of the present invention.
Figure 11:
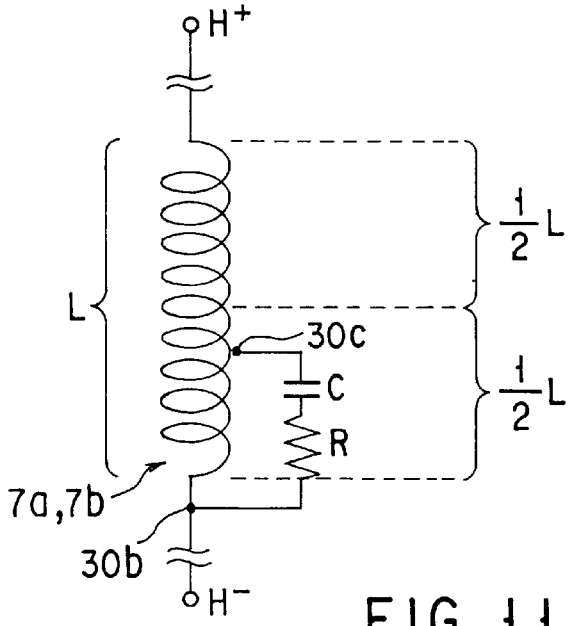
FIG. 11 is a circuit diagram showing the position of a third terminal of the horizontal deflection coil of the deflection yoke, which is included in a color cathode ray tube apparatus according to the fifth embodiment of the present invention.

On the other hand, according to the fifth embodiment of the present invention, a capacitor C and a resistor R are connected in series between the second terminal 30*b* of each of the horizontal deflection coils 7*a,* 7*b* and the third connection terminal 30*c,* as shown in FIGS. 10 and 11. The capacitance of the capacitor C and the resistance of the resistor R are selected appropriately by, for example, the inductance L of each of the horizontal deflection coils 7*a,* 7*b,* the distributed capacitance, the deflection current, and the state of the ringing generation. The fifth embodiment is equal to the first embodiment in the other portions and, thus, the same portions are denoted by the same reference numerals so as to avoid an overlapping description.

The fifth embodiment of the construction described above also permits producing the function and effect similar to those produced by the first embodiment. Also, where the resistor R is connected in series to the capacitor C, it is possible to suppress the current flowing into the resistor R even if the capacitor C is short-circuited because the potential difference between the terminals, to which the capacitor is connected, is smaller than that of the conventional case. It follows that it is possible to improve the safety of the color cathode ray tube.

The present invention is not limited to the embodiments described above and can be modified in various fashions within the technical scope of the present invention. For example, it is possible to connect the resistor R in series to the capacitor C in each of the second to fourth embodiments, too. Also, the technical idea of the present invention can be applied to not only the color cathode ray tube apparatus but also the monochromatic cathode ray tube apparatus.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus, comprising:

a vacuum envelope including a panel having a phosphor screen formed on an inner surface thereof and a funnel contiguous to the panel;

an electron gun arranged within a neck of the vacuum envelope, for emitting an electron beams toward the phosphor screen; and a deflection yoke mounted on the outer circumferential surface ranging from the neck to the funnel;

wherein the vacuum envelope has a tube axis, a first axis perpendicular to the tube axis, and a second axis perpendicular to both the tube axis and the first axis;

the deflection yoke includes a pair of horizontal deflection coils arranged to face each other with the first axis interposed therebetween, extending in the direction of the tube axis, for deflecting and scanning the electron beams in the direction of the first axis, and a pair of vertical deflection coils arranged to face each other with the second axis interposed therebetween, extending in the direction of the tube axis, for deflecting and scanning the electron beam in the direction of the second axis;

each of the horizontal deflection coil and the vertical deflection coil has the distribution of the winding within an angular region sandwiched between the first axis and the second axis in a cross section of the deflection yoke including both the first axis and the second axis, the winding of each horizontal deflection coil is mainly distributed in an angular region close to the first axis, and the winding of each vertical deflection coil is mainly distributed in an angular region close to the second axis;

the pair of horizontal deflection coils are connected in parallel to each other;

each of the horizontal deflection coils has a relatively high potential on the side of the first axis and a relatively low potential on the side of the second axis, and includes a first terminal positioned on the side of a relative high potential, a second terminal positioned on the side of a relatively low potential, and a third terminal positioned in the intermediate portion of the winding on the side of a low potential relative to a portion where the inductance of the horizontal deflection coil is equally divided into two halves; and a capacitor is connected between the third terminal of each of the horizontal deflection coils and the second terminal on the side of the low potential compared with the third terminal.

2. The cathode ray tube apparatus according to claim 1, wherein the second terminal of each of the horizontal deflection coils is provided at an end on the low potential side of the horizontal deflection coil.

3. The cathode ray tube apparatus according to claim 1, wherein the second terminal of each of the horizontal deflection coils is provided at the potential position of the connecting point between the side of the deflection yoke and the side of a driving circuit.

4. The cathode ray tube apparatus according to claim 1, wherein the second terminal of each of the horizontal deflection coils is provided at a ground potential portion.

5. The cathode ray tube apparatus according to claim 1, wherein a resistor is connected in series to the capacitor between the third terminal and the second terminal.

6. A cathode ray tube apparatus, comprising:

a vacuum envelope including a panel having a phosphor screen formed on an inner surface thereof and a funnel contiguous to the panel;

an electron gun arranged within the neck of the vacuum envelope, for emitting an electron beam toward the phosphor screen; and a deflection yoke mounted on the outer circumferential surface ranging from the neck to the funnel;

wherein the vacuum envelope has a tube axis, a first axis perpendicular to the tube axis, and a second axis perpendicular to both the tube axis and the first axis;

the deflection yoke includes a pair of horizontal deflection coils arranged to face each other with the first axis interposed therebetween, extending in the direction of the tube axis, for deflecting and scanning the electron beam in the direction of the first axis, and a pair of vertical deflection coils arranged to face each other with the second axis interposed therebetween, extending in the direction of the tube axis, for deflecting and scanning the electron beam in the direction of the second axis;

each of the horizontal deflection coil and the vertical deflection coil has the distribution of the winding within an angular region sandwiched between the first axis and the second axis in a cross section of the deflection yoke including both the first axis and the second axis, the winding of the horizontal deflection coil is mainly distributed in an angular region close to the first axis, and the winding of the vertical deflection coil is mainly distributed in an angular region close to the second axis;

the pair of horizontal deflection coils are connected in parallel to each other;

each of the horizontal deflection coils has a relatively high potential on the side of the first axis and a relatively low potential on the side of the second axis, and includes a first terminal positioned on the side of a relative high potential, a second terminal positioned on the side of a relatively low potential, and a third terminal positioned in the intermediate portion of the winding;

the third terminal is formed on the side of the second axis, compared with the distribution angle of the winding distribution of the vertical deflection coil at the edge on the side of the first axis; and a capacitor is connected between the third terminal of each of the horizontal deflection coils and the second terminal on the side of the low potential compared with the third terminal or the ground potential portion.

7. The cathode ray tube apparatus according to claim 6, wherein the second terminal of each of the horizontal deflection coils is provided at an end on the low potential side of the horizontal deflection coil.

8. The cathode ray tube apparatus according to claim 6, wherein the second terminal of each of the horizontal deflection coils is provided at the potential position of the connecting point between the deflection yoke and a driving circuit.

9. The cathode ray tube apparatus according to claim 6, wherein the second terminal of each of the horizontal deflection coils is provided at a ground potential portion.

10. The cathode ray tube apparatus according to claim 6, wherein a resistor is connected in series to the capacitor between the third terminal and the second terminal.

* * * * *